US006328683B1

(12) United States Patent
Rautenberg

(10) Patent No.: US 6,328,683 B1
(45) Date of Patent: Dec. 11, 2001

(54) DEVICE FOR PULLING UP THE ENDS OF CONTINUOUSLY TRANSVERSE-CONVEYED FLAT TUBULAR SEGMENTS DURING THE PRODUCTION OF SACKS OR BAGS

(75) Inventor: Horst Rautenberg, Lienen (DE)

(73) Assignee: Windmöller & Hölscher, Lengerich (DE)

( * ) Notice: Subject to any disclaimer, the term of this patent is extended or adjusted under 35 U.S.C. 154(b) by 0 days.

(21) Appl. No.: 09/470,992

(22) Filed: Dec. 23, 1999

(30) Foreign Application Priority Data

Dec. 23, 1998 (DE) ..... 198 60 088
Feb. 8, 1999 (DE) ..... 199 05 040

(51) Int. Cl.[7] ..... B31B 1/76

(52) U.S. Cl. ..... 493/255; 493/212; 493/255; 493/313; 493/929

(58) Field of Search ..... 493/212, 218, 493/219, 231, 243, 245, 255, 256, 259, 260, 262, 263, 313, 929, 936; 53/570, 571

(56) References Cited

U.S. PATENT DOCUMENTS 3,765,309 * 10/1973 Joice ..... 493/190
3,896,708 * 7/1975 De Vries ..... 493/936
3,896,714 * 7/1975 Bosse ..... 493/243
6,042,526 * 3/2000 Baumer ..... 493/218

FOREIGN PATENT DOCUMENTS 714 028 11/1941 (DE) .
1 611 701 10/1971 (DE) ..... B31B/35/74
2 323 727 11/1974 (DE) ..... B31B/1/76
82 34 461 6/1983 (DE) ..... B31B/1/78

* cited by examiner

*Primary Examiner*—Peter Vo
*Assistant Examiner*—Hemant M. Desai
(74) *Attorney, Agent, or Firm*—Jacobson Holman, PLLC

(57) ABSTRACT

A device for pulling up the ends of transverse-conveyed flat tubular segments during the production of sacks or bags comprises lateral support elements, which run parallel to the conveying zone and between which a slit is formed that lies in the conveying plane and beyond which the ends to be pulled up project, and comprising mechanisms for pre-opening the ends by pulling apart the tubular sides that lie on top of each other. To pull up easily the ends of the tubular segments, the support elements in one section of the conveying zone form an obtuse angle in the shape of a peaked roof behind the mechanisms for pre-opening. In this section at least one roll is positioned in such a manner at the support elements that the leading tubular edge strikes the roll.

20 Claims, 2 Drawing Sheets

DEVICE FOR PULLING UP THE ENDS OF CONTINUOUSLY TRANSVERSE-CONVEYED FLAT TUBULAR SEGMENTS DURING THE PRODUCTION OF SACKS OR BAGS

BACKGROUND OF THE INVENTION

1. Field of the Invention

The invention relates to a device for pulling up the ends of continuously transverse-conveyed flat tubular segments during the production of sacks or bags. The inventive device comprises lateral support elements, which run parallel to the conveying zone and between which a slit is formed that lies in the conveying plane and beyond which the ends to be pulled up project, and the inventive device comprises mechanisms for pre-opening the ends by pulling apart the tubular sides that lie on top of each other.

2. Description of the Related Art

To produce the socalled block bottom bags, one end or both ends of a flat lying tubular segment is/are drawn up into socalled bottom squares. These bottom squares comprise socalled comer flaps made of isosceles triangles, whose base edges, which run parallel to each other, are spaced apart. The bottom squares are then sealed by folding so as to overlap and then by gluing the socalled side flaps while optionally inserting a socalled bottom slip and a valve tube.

From DE-AS 16 11 701, DE-PS 23 23 727 and DE-GM 82 34 461 it is known, for example, to pull up the ends of the tubular segments using suction mechanisms or also just to pre-open and then to smooth out the corner flaps of the bottom squares with rotating sickle-shaped spreading members. In so doing, there is the specific problem of adapting these rotating spreading members with such precision to the ends of the continuously conveyed tubular segments that said ends are spread out as smooth as possible without tears.

SUMMARY OF THE INVENTION

The object of the invention is to provide a device of the aforementioned type with which the ends of the tubular segments can be easily pulled up into bottom squares.

The invention solves this problem in that in one section of the conveying zone the support elements form an obtuse angle in the shape of a peaked roof behind the mechanisms for pre-opening and that in this section at least one roll is positioned in such a manner at the support elements that the leading tubular edge strikes this roll.

With the device according to the invention one end or both ends of the tubular segments can be pulled up easily into bottom squares. The bottoms, which are pre-opened, for example, with suction mechanisms that travel along over a short distance, run into the slit between the support plates, which are angled off so as to form a peaked roof, and the biconical roll, whereby the sides lying between the lateral corner flaps are pulled apart so as to form the corner flaps. This pulling apart of the sides of the ends is done in the slit in such a manner that the circumferential speed of the biconical roll increases, starting from its center plane. This circumferential speed, which increases continuously on both sides in the outwardly direction, causes the sides of the tubular segments that rest under friction against the cone-shaped shell to be pulled toward the outside while simultaneously pulling up the bottom square.

A preferred embodiment provides that the roll comprises two straight truncated cones, which are connected together via their smaller bases and have the same vertex angles.

Expediently the smallest average diameter of the biconical roll lies in the conveying plane, and the surface lines of the biconical roll that face the support elements form together with the same a passage slit for the ends.

The support elements and the surface lines of the biconical roll run expediently parallel to each other.

Preferably the circumferential speed at the center of the driven biconical roll is greater than the conveying speed of the tubular segments.

The support elements are designed expediently as support plates.

Expediently the biconical roll exhibits a smooth surface so that it can grasp the ends to the tubular segments to be pulled up.

A preferred embodiment provides that the support plates in the area of the biconical roll have break-throughs that penetrate the freely rotatable support rolls. These support rolls, which slightly raise the sides of the ends to be pulled up from the support plates, facilitate the pulling up.

A preferred embodiment provides that in the region of the biconical roll there are on both sides laterally from said biconical roll driven conical rolls, whose surface lines, facing the support plates, define the passage slit with the same, and that the circumferential speed of the conical rolls is greater at their smallest inside diameter than the conveying speed of the tubular segments. These additional conical rolls support the pulling out of the ends into the bottom squares and the smoothing out process.

Expediently the lateral distance between the conical rolls and the biconical roll can be adjusted.

Expediently the average circumferential speed of the biconical roll is about three times the conveying speed of the tubular segments. The average circumferential speed of the outer conical rolls is also expediently three times the conveying speed of the tubular segments.

BRIEF DESCRIPTION OF THE DRAWINGS

One embodiment of the invention is explained in detail below with reference to the drawings.

DETAILED DESCRIPTION OF THE PREFERRED EMBODIMENTS

Figures 1, 2, 3, 4, 5:
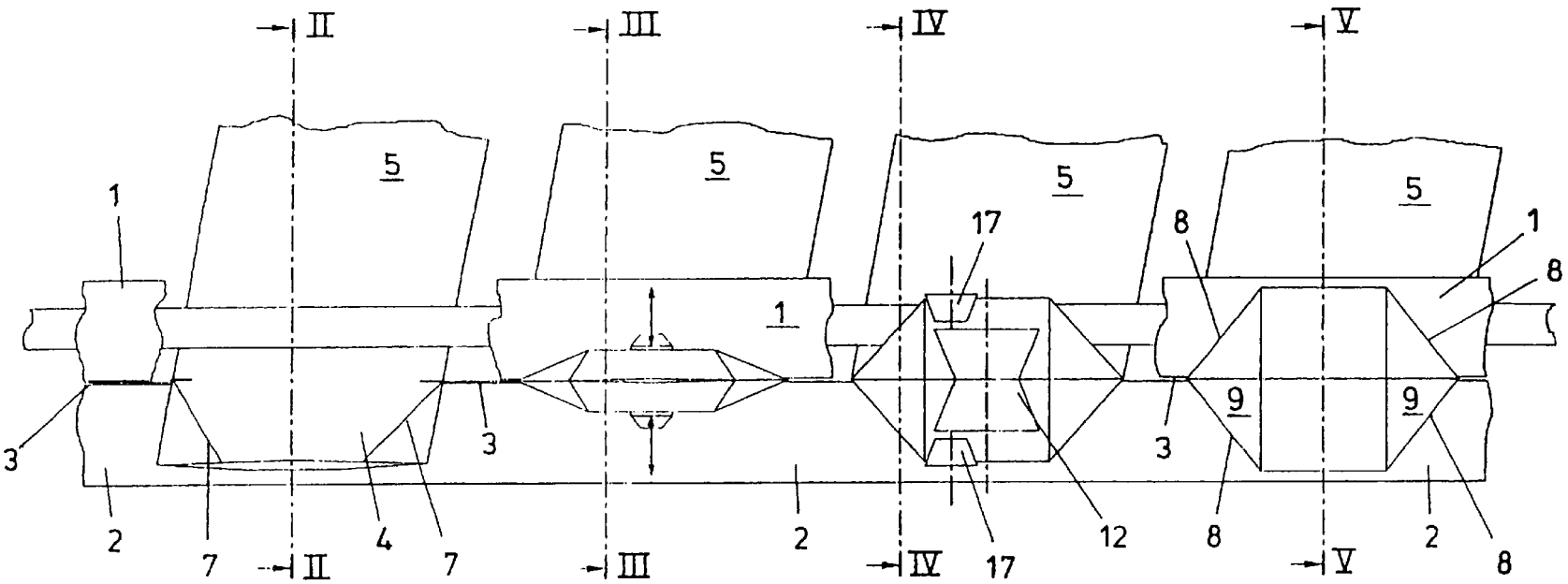
FIG. 1 depicts the end regions of the transverse-conveyed tubular segments while they are being pulled up into socalled bottom squares in a device for transverse conveyance with the pull-up mechanisms of the invention.
FIG. 2 to FIG. 5 are cross sectional views of the tubular segments and device along the lines II to V in FIG. 1.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The device, according to the invention, comprises two support plates 1, 2, which are arranged in a vertical plane and which define a slit 3, which projects beyond the ends 4 of the tubular segments 5 to be pulled up. The tubular segments 5 are conveyed in a horizontal direction using two parallel, clamping twin belt conveyors 6, whose strands clamp the respective tubular segments 5 between them. The ends of the tubular segments 5 to be pulled up are provided with groove lines 7, which run diagonally over their corners and along which the outer folding edges 8 of the corner flaps 9 are formed, in the region of the cross sectional line III and in FIG. 3, the side walls of the ends 4 of the tubular segments 5 are pulled apart in the direction of the double arrows 11 by means of suction mechanisms 10 that travel along over a short distance.

In front of the region along the cutline IV and in FIG. 4 the support plates 2 assume the shape of a peaked roof, symmetrical to the center conveying plane, by angling off into an obtuse angle as evident from FIGS. 3 and 4. In the region of FIG. 4 the support plates 1, 2, which are slanted into the shape of a peaked roof, exhibit a biconical roll 12, which comprises two identically formed truncated cones 13, which are connected together at their smaller bases. The surfaces of the biconical roll 12 that lie in a diametral plane form an obtuse angle that corresponds, for example, to the roof-shaped bend of the support plates 1, 2 so that between the surface lines, facing the support plates 1, 2, and the support plates a bent passage slit is formed for the two flaps of the ends of the sack segments 5 that are to be pulled up. In the region of the biconical roll 12 there are two support rolls 14, which are mounted so as to rotate freely and that penetrate the support plates 1, 2 in break-throughs so far that they project beyond the side of the support plates 1, 2 that faces the biconical roll 12. The support rolls 14 can be freely rotated around axes 15 that run parallel to the surface lines of the biconical roll 12 that face the support plates 1, 2. Both sides of the biconical roll 12 exhibit in the machine frame 16 rolls 17, which exhibit the shape of truncated cones and whose surface lines, facing the support plates 1, 2, also run parallel to the said support plates.

The biconical rolls are driven by a drive motor 18, whose speed can be preferably set. The drive of the conical rolls 17 is derived from the drive of the biconical roll 12 by means of belt drives 19. The speed of the conical rolls 17 can be modified by exchanging the drive wheels. Furthermore, the conical rolls 17 can be adjusted in the direction of their axes.

The conical rolls 17 are staggered expediently, as evident from FIG. 1, in the opposite conveying direction with respect to the biconical roll 12.

Figure 6:
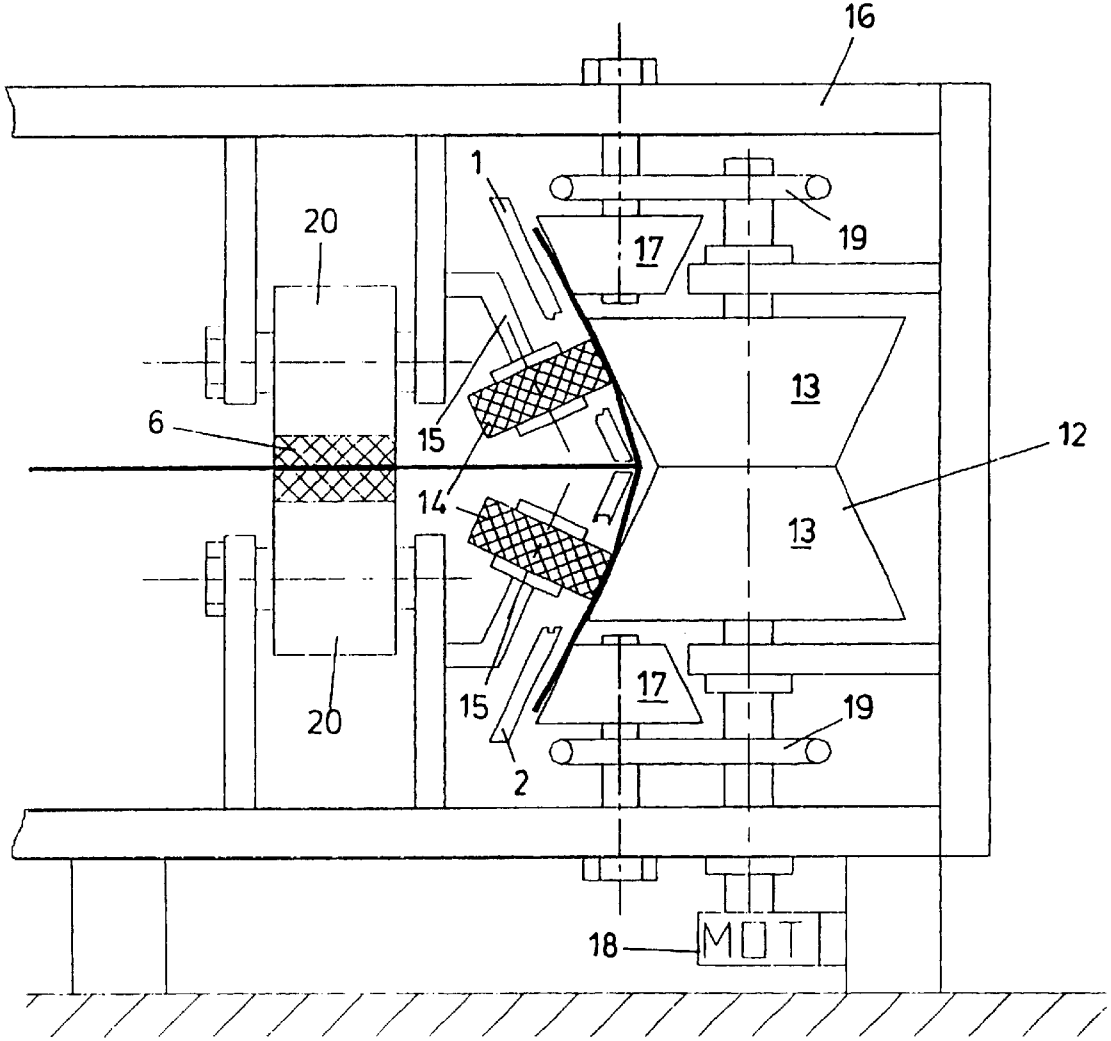
FIG. 6 is an enlarged view of FIG. 4.

The circumferential speed of the biconical roll 12 that increases toward the outside and also the additional conical rolls 17 produce an outwardly directed component that is generated by friction and that pulls up and smooths out the bottom squares as illustrated. The strands of the clamping twin belt conveyors 6 run over pressure rollers 20, as evident from FIG. 6.

On the way to the representation according to FIG. 5, the support plates 1, 2, which are bent in the shape of a peaked roof in the region of the biconical roll 12, assume more and more a position in which they lie in a common vertical plane.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A device for pulling up ends of continuously transverse-conveyed flat tubular segments during production of sacks or bags, comprising:

lateral support elements running parallel to a conveying zone and between which a slit is formed that lies in a conveying plane, the ends of said flat tubular segments projecting beyond said slit;

mechanisms for pre-opening the ends by pulling apart opposite sides of said tubular segments which lie on top of each other;

said support elements forming, in a section of said conveying zone, an obtuse angle to form a peaked-roof shape behind said mechanisms for pre-opening; and at least one biconical roll positioned in said section, said biconical roll including two straight truncated cones, which are connected together via their smaller bases and have a same vertex angle, said biconical roll positioned relative to said support elements such that a leading tubular edge strikes said biconical roll.

2. The device as claimed in claim 1, wherein a smallest average diameter of the biconical roll lies in the conveying plane, and surface lines of the biconical roll that face the support elements form together with said elements a passage slit for the ends.

3. The device as claimed in claim 2, wherein the support elements and the surface lines of the biconical roll run parallel to each other.

4. The device as claimed in claim 2, wherein on both sides laterally from said biconical roll there are driven conical rolls having surface lines facing the support elements and, with said support elements, define the passage slit, a circumferential speed of the conical rolls being greater at their smallest inside diameter than a conveying speed of the tubular segments.

5. The device as claimed in claim 4, wherein a lateral distance between the conical rolls and the biconical roll can be adjusted.

6. The device as claimed in claim 4, wherein an average circumferential speed of the conical rolls is about three times a conveying speed of the tubular segments.

7. The device as claimed in claim 1, wherein a circumferential speed of the biconical roll is greater in a central region thereof than a conveying speed of said tubular segments.

8. The device as claimed in claim 1, wherein the support elements are designed as support plates.

9. The device as claimed in claim 1, wherein the biconical roll exhibits a smooth surface.

10. The device as claimed in claim 1, wherein the support elements in an area adjacent the biconical roll have break-throughs through which freely rotatable support rolls penetrate.

11. The device as claimed in claim 1, wherein an average circumferential speed of the biconical roll is about three times a conveying speed of the tubular segments.

12. A device for pulling up ends of continuously transverse-conveyed flat tubular segments during production of sacks or bags, comprising:

lateral support elements running parallel to a conveying zone and between which a slit is formed that lies in a conveying plane, the ends of said flat tubular segments projecting beyond said slit;

at least one mechanism for pre-opening the ends by pulling apart opposite sides of said tubular segments;

said support elements forming, in a section of said conveying zone, an obtuse angle to form a peaked-roof shape behind said mechanisms for pre-opening; and at least one roll positioned in said section, said roll having a generally biconical shape defined by two truncated cones which are connected together via their smaller bases defining a smallest average diameter, said smallest average diameter lying in the conveying plane, said roll positioned relative to said support elements such that a leading tubular edge strikes said roll.

13. The device as claimed in claim 12, wherein a surface of said roll that faces the support elements forms together with said elements a passage slit for the ends.

14. The device as claimed in claim 13, wherein the support elements and the surface line of the roll run parallel to each other.

15. The device as claimed in claim 13, wherein on at least one side laterally from said roll, a conical roll having a surface faces the support elements and, with said support elements, defines the passage slit, a circumferential speed of the conical roll being greater at its smallest inside diameter than a conveying speed of the tubular segments.

16. The device as claimed in claim 15, wherein an average circumferential speed of the conical roll is about three times a conveying speed of the tubular segments.

17. The device as claimed in claim 12, wherein a circumferential speed of the roll is greater in a smallest diameter region thereof than a conveying speed of said tubular segments.

18. The device as claimed in claim 12, wherein the roll exhibits a smooth surface.

19. The device as claimed in claim 12, wherein the support elements in an area adjacent the roll have breakthroughs through which freely rotatable support rolls penetrate.

20. The device as claimed in claim 12, wherein an average circumferential speed of the roll is about three times a conveying speed of the tubular segments.

* * * * *